US010378396B2

(12) United States Patent
Okano et al.

(10) Patent No.: US 10,378,396 B2
(45) Date of Patent: Aug. 13, 2019

(54) VARIABLE VALVE-OPERATING DEVICE

(71) Applicant: HONDA MOTOR CO., LTD., Tokyo (JP)

(72) Inventors: Noriaki Okano, Wako (JP); Yoshihiro Takada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/861,282

(22) Filed: Jan. 3, 2018

(65) Prior Publication Data

US 2018/0223704 A1 Aug. 9, 2018

(30) Foreign Application Priority Data

Feb. 17, 2017 (JP) ..... 2017-028427

(51) Int. Cl.
*F01L 13/00* (2006.01)
*F01L 1/047* (2006.01)

(52) U.S. Cl.
CPC ..... *F01L 13/0015* (2013.01); *F01L 1/047* (2013.01); *F01L 13/0036* (2013.01);
(Continued)

(58) Field of Classification Search
CPC ... F01L 13/0015; F01L 13/0036; F01L 1/047; F01L 2013/0052; F01L 2013/0078; F01L 2001/0473
See application file for complete search history.

(56) References Cited

U.S. PATENT DOCUMENTS 8,353,264 B2 * 1/2013 Meintschel ..... F01L 1/053 123/90.18
8,910,544 B2 * 12/2014 Manteufel ..... F16H 25/12 123/90.6

(Continued)

FOREIGN PATENT DOCUMENTS

DE 102010053359 A1 * 6/2012 ..... F01L 13/0036
DE 102014204570 B3 * 7/2015 ..... F01L 13/0036

(Continued)

OTHER PUBLICATIONS

DE 19611641 English Language Machine Translation.*

*Primary Examiner* — Mark A Laurenzi
*Assistant Examiner* — Wesley G Harris
(74) *Attorney, Agent, or Firm* — Birch, Stewart, Kolasch & Birch, LLP

(57) ABSTRACT

A variable valve-operating device for an internal combustion engine has a cam carrier with cam lobes formed therearound to act on an engine valve and with a speed increasing side lead groove and a speed decreasing side lead groove formed therearound to be engaged with a speed increasing side switching pin and a speed decreasing side switching pin, respectively, to axially shift the cam carrier, to selectively make one of the cam lobes to be operative. A speed increasing side entry lead groove portion of the speed increasing side lead groove is formed in a position axially overlapping a low speed steady position lead groove portion of the speed decreasing side lead groove. A speed decreasing side entry lead groove portion of the speed decreasing side entry lead groove is formed in a position axially overlapping a high speed steady position lead groove portion of the speed increasing side lead groove. The variable valve-operating device can thus be miniaturized by reducing the axial width of the cam carrier.

3 Claims, 4 Drawing Sheets

(52) U.S. Cl.
CPC ..... *F01L 2001/0473* (2013.01); *F01L 2013/0052* (2013.01); *F01L 2013/0078* (2013.01)

(56) References Cited

U.S. PATENT DOCUMENTS

| | | | | |
|---|---|---|---|---|
| 2012/0024245 | A1* | 2/2012 | Nendel | F01L 13/0036 123/90.6 |
| 2014/0165940 | A1* | 6/2014 | Woo | F01L 13/005 123/90.18 |

FOREIGN PATENT DOCUMENTS

| | | | | |
|---|---|---|---|---|
| JP | 3980699 | B2 | 9/2007 | |
| WO | WO-2009083060 | A1 * | 7/2009 | F01L 1/053 |
| WO | WO-2010089068 | A1 * | 8/2010 | F01L 1/047 |

* cited by examiner

VARIABLE VALVE-OPERATING DEVICE

TECHNICAL FIELD

The present invention relates to a variable valve-operating device that changes actuation characteristics for an engine valve or valves of an internal combustion engine.

BACKGROUND ART

A variable valve-operating device for an internal combustion engine is known in which a cam carrier is fitted around a cam shaft of an engine valve train in a manner to be prevented from relative rotation relative to the cam shaft and to be slidable in an axial direction. The cam carrier has a plurality of cam lobes formed on the outer circumferential surface of the cam carrier. The cam lobes have different cam profiles determining valve actuation characteristics. The cam carrier is moved in the axial direction so that the different cam lobes can act on the engine valve to change valve actuation characteristics (see Patent Document 1, for example).

PRIOR ART DOCUMENT

Patent Document

[Patent Document 1] JP 3 980 699 B

In the variable valve-operating device disclosed in Patent Document 1, lead grooves as spiral grooves are formed in the cam carrier slidably fitted on the cam shaft, and switching pins engage with the lead grooves. The cam carrier is thereby guided in the axial direction and moved or shifted in the axial direction while rotated, so that change of the cam acting on the engine valve can be made.

One of the two lead grooves of the cam carrier disclosed in Patent Document 1 is a lead groove that shifts the cam carrier in one direction, and the other is a lead groove that shifts the cam carrier in the opposite direction.

The one lead groove that shifts the cam carrier either to the one direction or to the opposite direction is a speed increasing side lead groove for changing from a low speed side cam lobe having a small amount of valve lift to a high speed side cam lobe having a large amount of valve lift. The other lead groove is a speed decreasing side lead groove for changing from the high speed side cam lobe to the low speed side cam lobe.

SUMMARY OF THE INVENTION

Problem to be Solved by the Invention

The speed increasing side lead groove and the speed decreasing side lead groove both have an axial width corresponding to an amount of movement by which the cam carrier is shifted, and are formed in an outer circumferential surface of the cam carrier so as to be separated from each other in the axial direction.

Hence, the cam carrier occupies a large axial width because of the lead grooves, and the cam carrier is correspondingly increased in size.

The present invention has been made in view of the above. It is an object of the present invention to provide a variable valve-operating device that can be miniaturized by reducing the axial width of the cam carrier to a small amount.

Means for Solving the Problem

In order to achieve the above object, according to the present invention, there is provided a variable valve-operating device comprising a cam carrier in the form of a cylindrical member fitted around a cam shaft of a valve operating mechanism of an internal combustion engine so as to be inhibited from rotation relative to the cam shaft and slidable in an axial direction of the cam shaft, the cam carrier having a low speed side cam lobe and a high speed side cam lobe formed on an outer circumferential surface of the cam carrier to selectively act on an engine valve, the cam carrier also having lead grooves formed in the outer circumferential surface of the cam carrier and including a speed increasing side lead groove and a speed decreasing side lead groove, the cam lobes having different cam profiles and being adjacent to each other in an axial direction of the cam carrier, and switching pins for engagement with the lead grooves, the switching pins including a speed increasing side switching pin and a speed decreasing side switching pin; the speed increasing side switching pin and the speed decreasing side switching pin being adapted to engageably and disengageably advance into and retreat from the speed increasing side lead groove and the speed decreasing side lead groove, respectively, and one of the cam lobes to selectively act on the engine valve being determined by axially shifting the cam carrier with one of the switching pins selectively advanced to engage with one of the lead grooves of the cam carrier being rotated;

wherein the speed increasing side lead groove with which the speed increasing side switching pin is engageable is operative for change from the low speed side cam lobe to the high speed side cam lobe and the speed decreasing side lead groove with which the speed decreasing side switching pin engages is operative for change from the high speed side cam lobe to the low speed side cam lobe;

wherein the speed increasing side lead groove includes: a speed increasing side entry lead groove portion for accepting entry of the speed increasing side switching pin; a speed increasing switching lead groove portion extending from the speed increasing side entry lead groove portion to guide the cam carrier in the axial direction so as to move to a high speed side axial position; and a high speed steady position lead groove portion for enabling the cam carrier guided by the speed increasing switching lead groove portion to rotate steadily at the high speed side axial position;

wherein the speed decreasing side lead groove includes: a speed decreasing side entry lead groove portion for accepting entry of the speed decreasing side switching pin; a speed decreasing switching lead groove portion extending from the speed decreasing side entry lead groove portion to guide the cam carrier in the axial direction so as to move to a low speed side axial position; and a low speed steady position lead groove portion for enabling the cam carrier guided by the speed decreasing switching lead groove portion to rotate steadily at the low speed side axial position; and wherein the speed increasing side entry lead groove portion is formed at a position axially overlapping the low speed steady position lead groove portion, and the speed decreasing side entry lead groove portion is formed at a position axially overlapping the high speed steady position lead groove portion.

According to the above arrangement, the speed increasing side entry lead groove portion is formed at an axial position overlapping the low speed steady position lead groove portion, and the speed decreasing side entry lead groove portion is formed at an axial position overlapping the high speed steady position lead groove portion. Thus, the speed increasing side lead groove and the speed decreasing side lead groove are formed so as to overlap each other in the axial direction between the high speed steady position lead groove portion and the low speed steady position lead groove portion, with the high speed steady position lead groove portion and the low speed steady position lead groove portion extending around in a circumferential direction of the cam carrier. Therefore, axial width occupied by both the speed increasing side lead groove and the speed decreasing side lead groove in the cam carrier can be reduced to a small amount. It is thus possible to miniaturize the cam carrier, and in turn miniaturize the variable valve-operating device.

In the above-described arrangement, one of the speed increasing side lead groove and the speed decreasing side lead groove may have a smaller groove width and a larger depth to a groove bottom than the other.

According to this arrangement, one of the speed increasing side lead groove and the speed decreasing side lead groove has a smaller groove width and a larger depth to the groove bottom than the other. Thus, the switching pin engaging with the speed increasing side lead groove engages only with the speed increasing side lead groove, and the switching pin engaging with the speed decreasing side lead groove engages only with the speed decreasing side lead groove.

Therefore, the switching pin engaged with one lead groove of the lead groove having a smaller groove width and a larger depth to the groove bottom and the lead groove having a larger groove width and a smaller depth to the groove bottom can cross the other lead groove without any hindrance, and can smoothly shift the cam carrier while guided by the same one lead groove at all times, even in a portion intersecting the other lead groove.

In the above-described arrangement, the speed decreasing side lead groove may have a smaller groove width and a larger depth to a groove bottom than the speed increasing side lead groove.

According to this arrangement, the speed decreasing side lead groove for change from the high speed side cam lobe to the low speed side cam lobe has a smaller groove width and a larger depth to the groove bottom than the speed increasing side lead groove. Thus, the stroke of the speed decreasing side switching pin to be engaged with the speed decreasing side lead groove having the larger depth to the groove bottom is larger than the stroke of the speed increasing side switching pin. However, because of a low engine speed at the time of change from the high speed side cam lobe to the low speed side cam lobe, the speed decreasing side switching pin can timely advance into and engage with the speed decreasing side entry lead groove portion without a delay even though the speed decreasing side switching pin has a large stroke to engage with the speed decreasing side lead groove.

In the above-described arrangement, the speed increasing side switching pin and the speed decreasing side switching pin may be arranged at a same position in the axial direction and at positions separated from each other in a circumferential direction of the cam carrier.

According to this arrangement, the speed increasing side switching pin and the speed decreasing side switching pin are arranged at the same position in the axial direction and at positions separated from each other in the circumferential direction. Thus, the speed increasing side switching pin and the speed decreasing side switching pin that engage with the speed increasing side lead groove and the speed decreasing side lead groove overlapping and intersecting each other in the axial direction can be arranged without interfering with each other.

Effects of the Invention

According to the present invention, the speed increasing engagement lead groove portion is formed at an axial position overlapping the low speed steady position lead groove portion, and the speed decreasing engagement lead groove portion is formed at an axial position overlapping the high speed steady position lead groove portion. Thus, the speed increasing side lead groove and the speed decreasing side lead groove are formed so as to overlap each other between the low speed steady position lead groove portion and the high speed steady position lead groove portion in the axial direction. Therefore, axial width occupied by both the speed increasing side lead groove and the speed decreasing side lead groove in the cam carrier can be reduced to a small amount. It is thus possible to miniaturize the cam carrier, and in turn miniaturize the variable valve-operating device.

MODE FOR CARRYING OUT THE INVENTION

An embodiment of the present invention will hereinafter be described with reference to the drawings.

Figure 1:
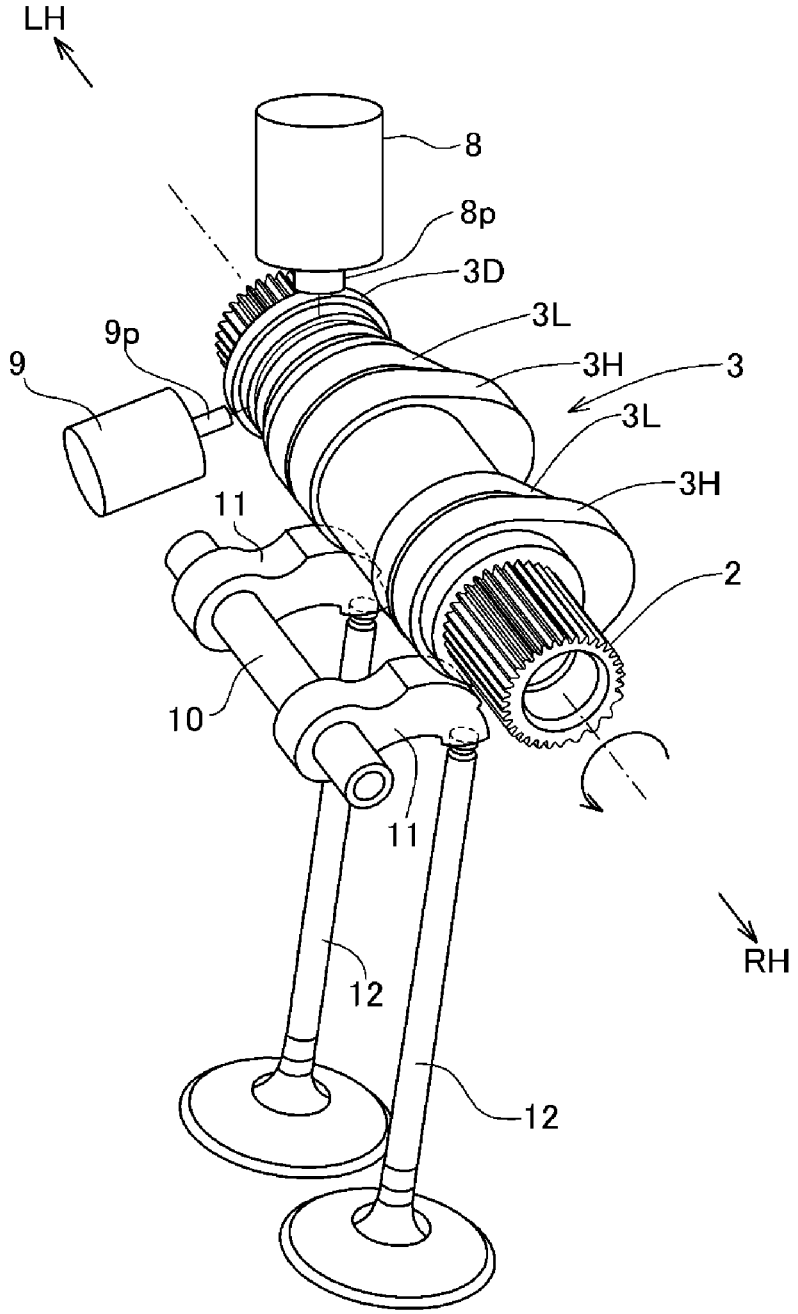
FIG. 1 is a perspective view of a variable valve-operating device according to an embodiment of the present invention.

FIG. 1 is a perspective view of principal parts of a variable valve-operating device 1 according to an embodiment to which the present invention is applied.

A cam carrier 3 as a cylindrical member is spline-fitted to a cam shaft 2 of a valve train or valve operating mechanism of a four-stroke internal combustion engine.

The cam carrier 3 is prevented from relative rotation with respect to the cam shaft 2, and is fitted to the cam shaft 2 slidably in the axial direction of the cam shaft.

The cam shaft 2 is oriented in a left-right direction of a vehicle on which the internal combustion engine is mounted.

In the drawings, LH denotes a left direction, and RH denotes a right direction.

The cam carrier 3 has a pair of a low speed side cam lobe 3L and a high speed side cam lobe 3H formed respectively on left and right sides in the axial direction on the outer circumferential surface of the cam carrier 3. The low speed side cam lobe 3L and the high speed side cam lobe 3H have different cam profiles and are adjacent to each other on the left and right in the axial direction.

Outer diameters of base circles of the cam profiles of the low and high speed side cam lobes 3L and 3H adjacent to each other are equal to each other. The low speed side cam lobe 3L and the high speed side cam lobe 3H are located at the same circumferential position.

The low speed side cam lobe 3L and the high speed side cam lobe 3H are in sliding contact with rocker arms 11, respectively, which are swingably supported by a rocker arm shaft 10 and operate to swing the rocker arms 11 to actuate intake and exhaust valves 12, respectively.

In the state depicted in FIG. 1, the high speed side cam lobes 3H are in sliding contact with the rocker arms 11, and the valves 12 are actuated by the high speed side cam lobes 3H, respectively.

Here, when the cam carrier 3 are moved in a right direction, the low speed side cam lobes 3L come into sliding contact with the rocker arms 11, and the valves 12 can be actuated by the low speed side cam lobes 3L, respectively.

That is, when the cam carrier 3 is shifted to the right, the cams actuating the valve 12 are changed from the high speed side cam lobes 3H to the low speed side cam lobes 3L, while when the cam carrier 3 is conversely shifted to the left, the cam actuating the valves 12 are changed from the low speed side cam lobes 3L to the high speed side cam lobes 3H.

Figure 2:
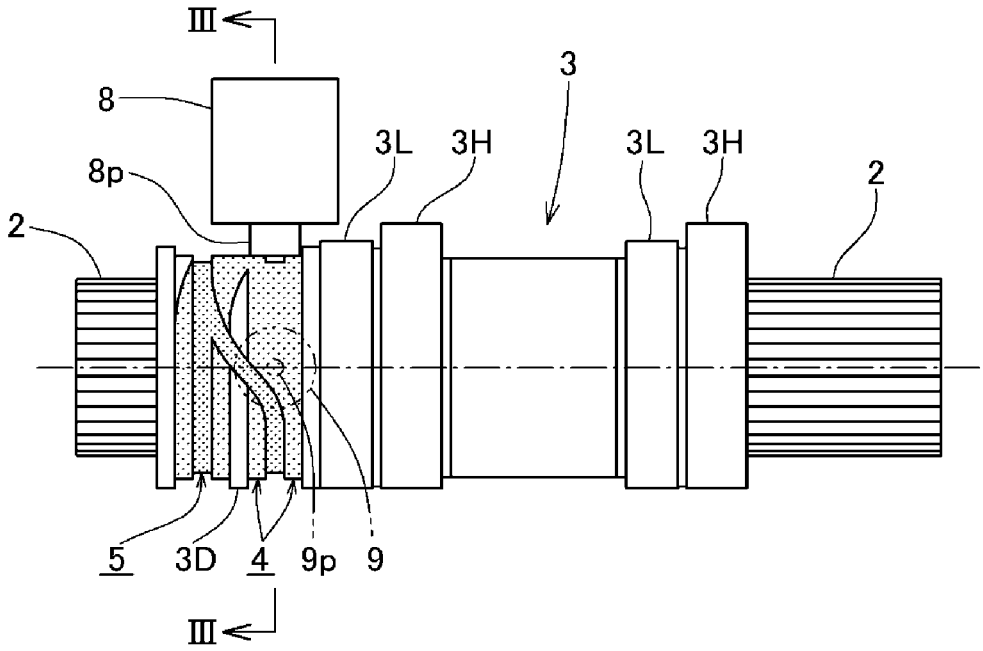
FIG. 2 is a side view of a cam carrier that is spline-fitted to a cam shaft.

Referring to FIGS. 1 and 2, the cam carrier 3 has a lead groove cylindrical portion 3D formed such that lead grooves 4 and 5 extend around the lead groove cylindrical portion 3D on the left side of the left low speed side cam lobe 3L of the pair of the low and high speed side cam lobes 3L and 3H.

The outer diameter of the lead groove cylindrical portion 3D is smaller than the outer diameter of the equal-diameter base circles of the low speed side cam lobe 3L and the high speed side cam lobe 3H.

There are two kinds of lead grooves, that is, a speed increasing side lead groove 4 for changing from the low speed side cam lobe 3L to the high speed side cam lobe 3H, and a speed decreasing side lead groove 5 for changing from the high speed side cam lobe 3H to the low speed side cam lobe 3L.

Figure 5:
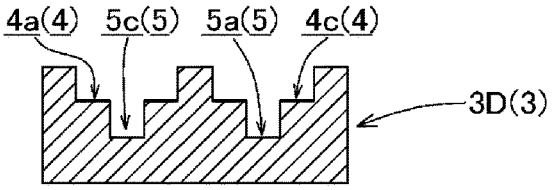
FIG. 5 is a sectional view of the lead groove cylindrical portion.

As will be noted from FIG. 5, the speed decreasing side lead grooves 5 have a smaller groove width and a larger depth to the groove bottom than the speed increasing side lead grooves 4.

A speed increasing side switching pin 8*p* as an advancing and retreating rod of a speed increasing side solenoid 8 can advance into and engage with the speed increasing side lead groove 4, and retreat and disengage from the speed increasing side lead groove 4.

Similarly, a speed decreasing side switching pin 9*p* as an advancing and retreating rod of a speed decreasing side solenoid 9 can advance into and engage with the speed decreasing side lead groove 5, and retreat and disengage from the speed decreasing side lead groove 5.

The speed increasing side switching pin 8*p* of a cylindrical shape has an outer diameter slightly smaller than the large groove width of the speed increasing side lead groove 4, and can therefore engage with and be in sliding contact with the speed increasing side lead groove 4.

Similarly, the speed decreasing side switching pin 9*p* of a cylindrical shape has an outer diameter slightly smaller than the small groove width of the speed decreasing side lead groove 5, and can therefore engage with and be in sliding contact with the speed decreasing side lead groove 5.

Hence, the speed increasing side switching pin 8*p* engages only with the speed increasing side lead groove 4, and the speed decreasing side switching pin 9*p* engages only with the speed decreasing side lead groove 5.

Figure 3:
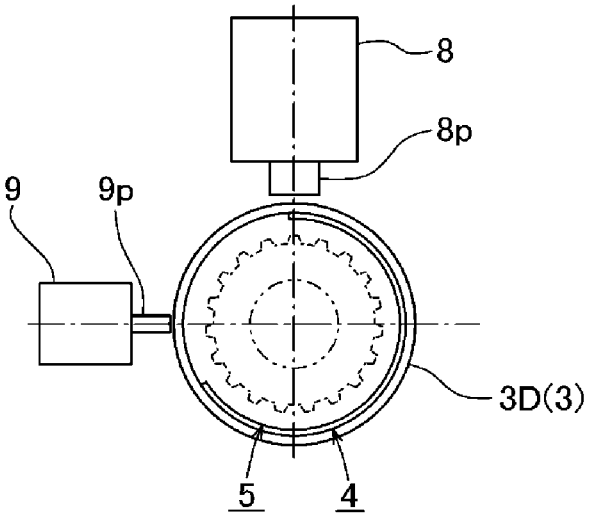
FIG. 3 is a sectional view taken in the direction of arrows III-III in FIG. 2.

The speed increasing side solenoid 8 and the speed decreasing side solenoid 9 are located around the periphery of the lead groove cylindrical portion 3D of the cam carrier 3 and at the same axial position, and are separated from each other in the circumferential direction of the lead groove cylindrical portion 3D. As depicted in FIG. 3, the speed increasing side switching pin 8*p* and the speed decreasing side switching pin 9*p* are directed to the center axis of the lead groove cylindrical portion 3D and project in directions orthogonal to each other. The speed increasing side switching pin 8*p* is located ahead of the speed decreasing side switching pin 9*p* by a phase angle of 90 degrees in the rotational direction of the cam carrier 3.

Figure 4:
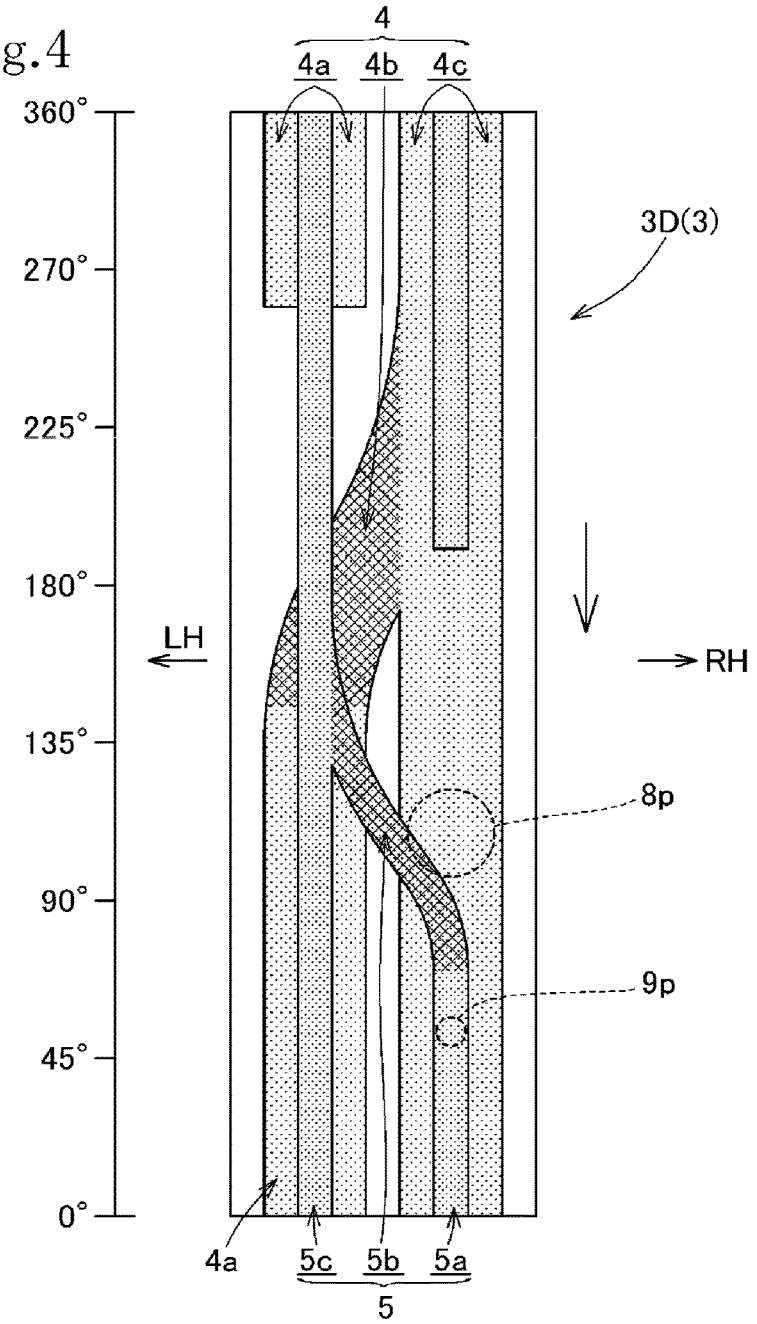
FIG. 4 is a developed view of a speed increasing lead groove and a speed decreasing lead groove in a lead groove cylindrical portion of the cam carrier.

FIG. 4 shows a developed view of the speed increasing side lead groove 4 and the speed decreasing side lead groove 5 formed in the lead groove cylindrical portion 3D.

In FIG. 4, the speed increasing side lead groove 4 and the speed decreasing side lead groove 5 are shown with scattered dot patterns. The speed decreasing side lead groove 5 is shown with highly denser scattered dots to be thus darker than the speed increasing side lead groove 4.

The speed increasing side lead groove 4 includes: a speed increasing side entry lead groove portion 4*a* for accepting the incoming speed increasing side switching pin 8*p*; a speed increasing switching lead groove portion 4*b* extending from the speed increasing side entry lead groove portion 4*a* to shift the cam carrier 3 to the left in the axial direction to move the cam carrier 3 to a high speed side axial position; and a high speed steady position lead groove portion 4*c* for enabling the cam carrier 3, after guidance by the speed increasing switching lead groove portion 4*b*, to rotate steadily at the high speed side axial position.

The speed decreasing side lead groove 5 includes: a speed decreasing side entry lead groove portion 5*a* for accepting the incoming speed decreasing side switching pin 9*p*; a speed decreasing switching lead groove portion 5*b* extending from the speed decreasing side entry lead groove portion 5*a* to shift the cam carrier 3 to the right in the axial direction to move the cam carrier 3 to a low speed side axial position; and a low speed steady position lead groove portion 5*c* for enabling the cam carrier 3, after guidance by the speed decreasing switching lead groove portion 5*b*, to rotate steadily at the low speed side axial position.

The high speed steady position lead groove portion 4*c* of the speed increasing side lead groove 4 is formed fully around the lead groove cylindrical portion 3D in the circumferential direction and adjacent to the right edge of the lead groove cylindrical portion 3D. The low speed steady position lead groove portion 5*c* of the speed decreasing side lead groove 5 is formed fully around the lead groove cylindrical portion 3D in the circumferential direction and adjacent to the left edge of the lead groove cylindrical portion 3D.

The speed increasing side entry lead groove portion 4*a* of the speed increasing side lead groove 4 is formed at a left side position where the speed increasing side entry lead groove portion 4*a* overlaps, in the axial direction, the low speed steady position lead groove portion 5*c* of the speed decreasing side lead groove 5. The speed increasing switching lead groove portion 4*b* (lattice-hatched part in FIG. 4) extends from the speed increasing side entry lead groove portion 4*a* toward the right side. The speed increasing switching lead groove portion 4*b* merges into the high speed steady position lead groove portion 4*c* on the right side.

In addition, the speed decreasing side entry lead groove portion 5*a* of the speed decreasing side lead groove 5 is formed at a right side position where the speed decreasing side entry lead groove portion 5*a* overlaps, in the axial direction, the high speed steady position lead groove portion 4*c* of the speed increasing side lead groove 4. The speed decreasing switching lead groove portion 5*b* (lattice-hatched part in FIG. 4) extends from the speed decreasing side entry lead groove portion 5*a* to the left side. The speed decreasing switching lead groove portion 5*b* merges into the low speed steady position lead groove portion 5*c* on the left side.

Hence, the speed increasing side lead groove 4 and the speed decreasing side lead groove 5 are formed so as to axially overlap each other between the high speed steady position lead groove portion 4*c* and the low speed steady position lead groove portion 5*c*, and the high speed steady position lead groove portion 4*c* and the low speed steady position lead groove portion 5*c* extend circumferentially fully around the lead groove cylindrical portion 3D. Therefore, axial width occupied by both the speed increasing side lead groove 4 and the speed decreasing side lead groove 5 in the cam carrier 3 can be reduced to a smaller width than before.

Incidentally, the speed increasing switching lead groove portion 4*b* (lattice-hatched part in FIG. 4) of the speed increasing side lead groove 4, which switching lead groove portion guides the cam carrier 3 to the high speed side axial position, is formed ahead of the speed decreasing switching lead groove portion 5*b* (lattice-hatched part in FIG. 4), for guiding the cam carrier 3 to the low speed side axial position, of the speed decreasing side lead groove 5 by a phase angle of 90 degrees in the rotational direction.

This arrangement is based on the arrangement in which the speed increasing side switching pin 8*p* is located ahead of the speed decreasing side switching pin 9*p* by a phase angle of 90 degrees in the rotational direction of the cam carrier 3.

The cam carrier 3 is shifted when the base circle common to the low and high speed side cam lobes 3L and 3H of the cam carrier 3 acts on the rocker arms 11, whereby switching between the low speed side cam lobe 3L and the high speed side cam lobe 3H can be performed smoothly.

The cam carrier 3 can be configured such that the timing at which the speed decreasing side switching pin 9*p* engages with the speed decreasing switching lead groove portion 5*b* to shift the cam carrier 3 to the right and the timing at which the speed increasing side switching pin 8*p* ahead by a phase angle of 90 degrees in the rotational direction engages with the speed increasing switching lead groove portion 4*b* to shift the cam carrier 3 to the left, coincide with the timing at which the base circle common to the low speed side cam lobe 3L and the high speed side cam lobe 3H acts on the rocker arms 11.

Referring to the explanatory view of FIG. 6, description will be made of operation made when switching between the low speed side cam lobes 3L and the high speed side cam lobes 3H is performed by moving the cam carrier 3 in the variable valve-operating device 1, and the low speed side cam lobes 3L and the high speed side cam lobes 3H are made to act on the valves 12 via the rocker arms 11, respectively.

Figure 6:
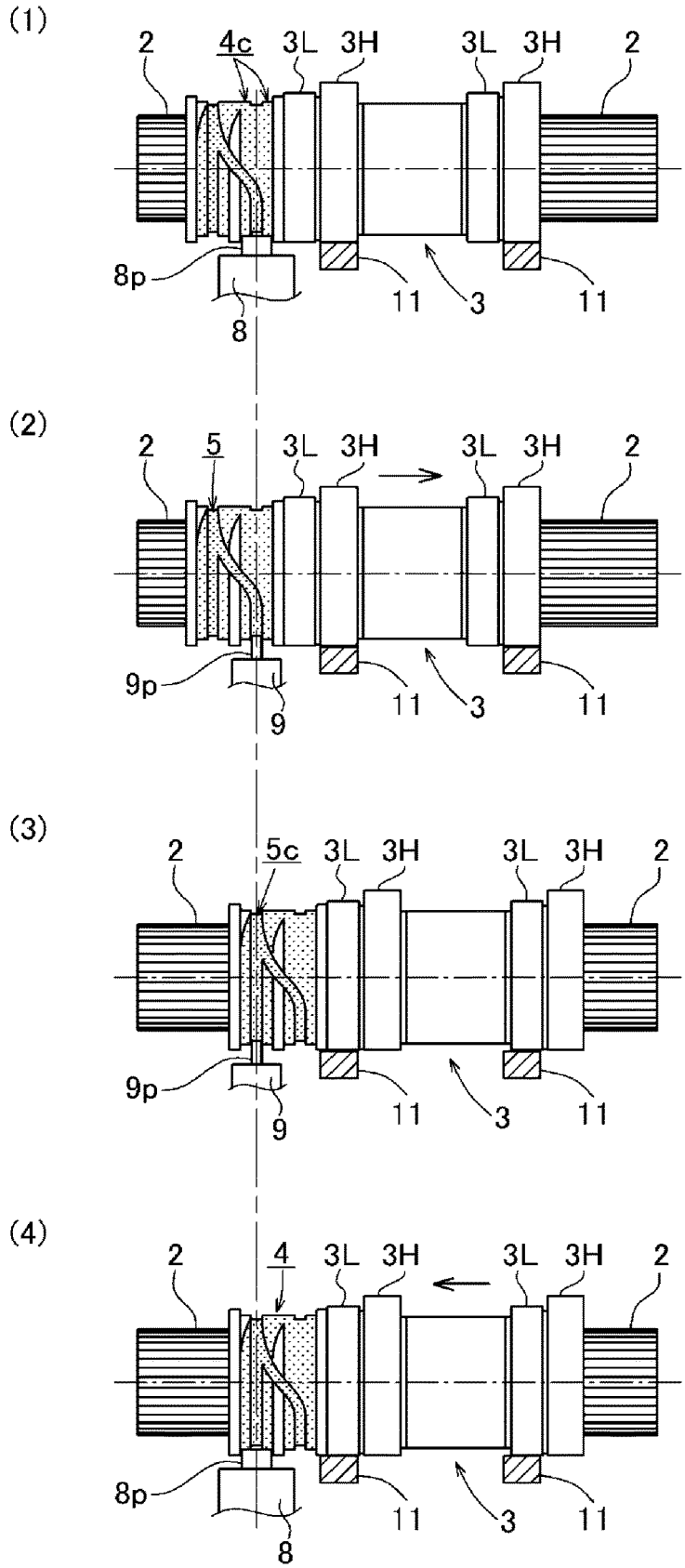
FIG. 6 is an explanatory view depicting operational processes of principal members of the variable valve-operating device in the order of lapse of time.

FIG. 6 depicts operational processes of principal members of the variable valve-operating device 1 in the order of passage of time.

In the state depicted in (1) of FIG. 6, the cam carrier 3 is located at a left side position, and the high speed side cam lobes 3H act on the rocker arms 11, so that the valves 12 are operated according to a valve actuation characteristic set in the cam profile of the high speed side cam lobes 3H.

At this time, the speed increasing side solenoid 8 is operated to project the speed increasing side switching pin 8*p*, which engages with the high speed steady position lead groove portion 4*c* of the speed increasing side lead groove 4, and the high speed steady position lead groove portion 4*c* extending fully around the circumference on the right side, so that the cam carrier 3 rotates steadily at a high speed steady position as a left-shifted position.

After the speed increasing side solenoid 8 is operated to retract the speed increasing side switching pin 8*p* from the above state to thus disengage the speed increasing side switching pin 8*p* from the high speed steady position lead groove portion 4*c*, the speed decreasing side solenoid 9 is operated to project the speed decreasing side switching pin 9*p* to advance the switching pin 9*p* into the speed decreasing side entry lead groove portion 5*a* of the speed decreasing side lead groove 5, to cause the speed decreasing side switching pin 9*p* to engage with the speed decreasing side lead groove 5.

A state immediately after the speed decreasing side switching pin 9*p* is advanced into the speed decreasing side entry lead groove portion 5*a* after the disengagement of the speed increasing side switching pin 8*p* from the high speed steady position lead groove portion 4*c* is depicted in (2) of FIG. 6.

When the cam carrier 3 rotates in this state, the speed decreasing side switching pin 9*p* engaged with the speed decreasing side entry lead groove portion 5*a* is moved to the speed decreasing switching lead groove portion 5*b* to engage with the speed decreasing switching lead groove portion 5*b*. The speed decreasing switching lead groove portion 5*b* therefore operates to cause the cam carrier 3 to move rightward in the axial direction and shifts the cam carrier 3 to the right while the cam carrier 3 rotates.

The speed decreasing switching lead groove portion 5*b* is formed so as to intersect the speed increasing side lead groove 4. However, the speed decreasing switching lead groove portion 5*b* has a smaller groove width and a larger depth to the groove bottom than the speed increasing side lead groove 4. Therefore, even in the portion intersecting the speed increasing side lead groove 4, the speed decreasing side switching pin 9*p* engaged with the speed decreasing switching lead groove portion 5*b* can cross the speed increasing side lead groove 4 without any hindrance, and can smoothly shift the cam carrier 3 to the right while guided by the same speed decreasing switching lead groove portion 5*b* at all times.

Further rotation of the cam carrier 3 causes the speed decreasing side switching pin 9*p* engaged with the speed decreasing switching lead groove portion 5*b* to move into the low speed steady position lead groove portion 5*c*. As depicted in (3) of FIG. 6, the speed decreasing side switching pin 9*p* engages with the low speed steady position lead groove portion 5*c*, and therefore the cam carrier 3 rotates steadily at a low speed steady position as a right-shifted position.

The cam carrier 3 is shifted to the right, and rotates steadily at the low speed steady position due to the low speed steady position lead groove portion 5*c*. Thus, as depicted in (3) of FIG. 6, the low speed side cam lobes 3L act on the rocker arms 11 instead of the high speed side cam lobes 3H, and the valves 12 are operated according to a valve actuation characteristic set in the cam profile of the low speed side cam lobes 3L.

When the cam carrier 3 is to be shifted to the left to change the cam lobes acting on the valves 12 from the low speed side cam lobes 3L to the high speed side cam lobes 3H, the speed decreasing side switching pin 9*p* rotating steadily at the low speed steady position as the right-shifted position is disengaged from the low speed steady position lead groove portion 5*c*, and thereafter the speed increasing side switching pin 8*p* is projected and advanced into the speed increasing side entry lead groove portion 4*a* of the speed increasing side lead groove 4 so that, as depicted in (4) of FIG. 6, the speed increasing side switching pin 8*p* is engaged with the speed increasing side entry lead groove portion 4*a*.

When the cam carrier 3 rotates in this state, the speed increasing side switching pin 8*p* engaged with the speed increasing side entry lead groove portion 4*a* moves to the speed increasing switching lead groove portion 4*b* and engages with the speed increasing switching lead groove portion 4*b*. The speed increasing switching lead groove portion 4*b* therefore operates to guide the cam carrier 3 leftward in the axial direction and shifts the cam carrier 3 to the left while the cam carrier 3 rotates.

Further rotation of the cam carrier 3 causes the speed increasing side switching pin 8*p* engaged with the speed increasing switching lead groove portion 4*b* to move to the high speed steady position lead groove portion 4*c*. As depicted in (1) of FIG. 6, the speed increasing side switching pin 8*p* engages with the high speed steady position lead groove portion 4*c*, and therefore the cam carrier 3 rotates steadily at the high speed steady position as the left-shifted position. The high speed side cam lobes 3H act on the rocker arms 11 instead of the low speed side cam lobes 3L, and the valves 12 are operated according to the valve actuation characteristic set in the cam profile of the high speed side cam lobes 3H.

The speed increasing switching lead groove portion 4*b* is formed so as to intersect the speed decreasing side lead groove 5. However, the speed increasing switching lead groove portion 4*b* has a larger groove width and a smaller depth to the groove bottom than the speed decreasing side lead groove 5. Therefore, even in the portion intersecting the speed decreasing side lead groove 5, the speed increasing side switching pin 8*p* engaged with the speed increasing switching lead groove portion 4*b* can cross the speed decreasing side lead groove 5 without any hindrance, and can smoothly shift the cam carrier 3 to the left while guided by the same speed increasing switching lead groove portion 4*b* at all times.

An embodiment of the variable valve-operating device according to the present invention described above in detail produces effects described in the following.

As depicted in FIGS. 2 and 4, the speed increasing side entry lead groove portion 4*a* is formed in a position axially overlapping the low speed steady position lead groove portion 5*c*, and the speed decreasing side entry lead groove portion 5*a* is formed in a position axially overlapping the high speed steady position lead groove portion 4*c*. Thus, the speed increasing side lead groove 4 and the speed decreasing side lead groove 5 are formed so as to overlap each other in the axial direction between the high speed steady position lead groove portion 4*c* and the low speed steady position lead groove portion 5*c*, with the high speed steady position lead groove portion 4*c* and the low speed steady position lead groove portion 5*c* extending around in the circumferential direction. Therefore, total axial direction width occupied by both the speed increasing side lead groove 4 and the speed decreasing side lead groove 5 in the cam carrier 3 is reduced. It is consequently possible to miniaturize the cam carrier 3, and in turn miniaturize the variable valve-operating device 1.

Referring to FIGS. 4 and 5, the speed decreasing side lead groove 5 has a smaller groove width and a larger depth to the groove bottom than the speed increasing side lead groove 4. Thus, the speed increasing side switching pin 8*p* engages only with the speed increasing side lead groove 4, and the speed decreasing side switching pin 9*p* engages only with the speed decreasing side lead groove 5. Therefore, the switching pin engaged with one lead groove of the speed decreasing side lead groove 5 having a smaller groove width and a larger depth to the groove bottom and the speed increasing side lead groove 4 having a larger groove width and a smaller depth to the groove bottom can cross the other lead groove without any hindrance, and can smoothly shift the cam carrier 3 while guided by the same one lead groove at all times, even in the portion intersecting the other lead groove.

Referring to FIG. 3, the speed decreasing side lead groove 5 for change from the high speed side cam lobe 3H to the low speed side cam lobe 3L has a smaller groove width and a larger depth to the groove bottom than the speed increasing side lead groove 4. Thus, the stroke of the speed decreasing side switching pin 9*p* to be engaged with the speed decreasing side lead groove 5 having the larger depth to the groove bottom is larger than the stroke of the speed increasing side switching pin 8*p*. However, because of low engine speed at the time of change from the high speed side cam lobe 3H to the low speed side cam lobe 3L, the speed decreasing side switching pin 9*p* can timely advance into the speed decreasing side entry lead groove portion 5*a* and engage with the speed decreasing side lead groove 5 without a delay even though the speed decreasing side switching pin 9*p* has a large stroke to engage with the speed decreasing side lead groove 5.

Referring to FIG. 1, the speed increasing side switching pin 8*p* and the speed decreasing side switching pin 9*p* are arranged at the same position with respect to the axial direction and at positions separated from each other by an angle of 90 degrees in the circumferential direction of the cam carrier 3. Thus, the speed increasing side switching pin 8*p* and the speed decreasing side switching pin 9*p* for engagement, respectively, with the speed increasing side lead groove 4 and the speed decreasing side lead groove 5 overlapping and intersecting each other in the axial direction, can be arranged without interfering with each other.

The speed increasing switching lead groove portion 4*b* is formed ahead of the speed decreasing switching lead groove portion 5*b* by a phase angle of 90 degrees in the rotational direction. Therefore, the timing at which the speed decreasing side switching pin 9*p* engages with the speed decreasing switching lead groove portion 5*b* and shifts the cam carrier 3 to the right and the timing at which the speed increasing side switching pin 8*p* ahead by a phase angle of 90 degrees in the rotational direction engages with the speed increasing switching lead groove portion 4*b* and shifts the cam carrier 3 to the left, can be made to coincide with the timing at which the base circle common to the low speed side cam lobe 3L and the high speed side cam lobe 3H acts on the rocker arms 11. The cam carrier 3 can therefore be smoothly shifted without any hindrance.

A variable valve-operating device 1 according to an embodiment of the present invention has been described above. However, modes of the present invention are not limited to the foregoing embodiment, but include embodiments carried out in various modes without departing from the spirit of the present invention.

DESCRIPTION OF REFERENCE SIGNS

1 . . . Variable valve-operating device, 2 . . . Cam shaft, 3 . . . Cam carrier, 3L . . . Low speed side cam lobe, 3H . . . High speed side cam lobe, 3D . . . Lead groove cylindrical portion,

4 . . . Speed increasing side lead groove, 4*a* . . . Speed increasing side entry lead groove portion, 4*b* . . . Speed increasing switching lead groove portion, 4*c* . . . High speed steady position lead groove portion,

5 . . . Speed decreasing side lead groove, 5*a* . . . Speed decreasing side entry lead groove portion, 5*b* . . . Speed decreasing switching lead groove portion, 5*c* . . . Low speed steady position lead groove portion,

8 . . . Speed increasing side solenoid, 8*p* . . . Speed increasing side switching pin, 9 . . . Speed decreasing side solenoid, 9*p* . . . Speed decreasing side switching pin,

10 . . . Rocker arm shaft, 11 . . . Rocker arm, 12 . . . Valve

The invention claimed is:

1. A variable valve-operating device comprising:

a cam carrier in the form of a cylindrical member fitted around a cam shaft of a valve operating mechanism of an internal combustion engine so as to be inhibited from rotation relative to the cam shaft and slidable in an axial direction of the cam shaft, the cam carrier having a low speed side cam lobe and a high speed side cam lobe formed on an outer circumferential surface of the cam carrier to selectively act on an engine valve, the cam carrier also having lead grooves formed in the outer circumferential surface of the cam carrier and including a speed increasing side lead groove and a speed decreasing side lead groove, the low speed side cam lobe and the high speed cam lobe having different cam profiles and being adjacent to each other in an axial direction of the cam carrier, and switching pins for engagement with the lead grooves, the switching pins including a speed increasing side switching pin and a speed decreasing side switching pin, wherein the speed increasing side switching pin and the speed decreasing side switching pin are adapted to engageably and disengageably advance into and retreat from the speed increasing side lead groove and the speed decreasing side lead groove, respectively, and one of the low speed side cam lobe and the high speed cam lobe to selectively act on the engine valve is determined by axially shifting the cam carrier with one of the switching pins selectively advanced to engage with one of the lead grooves of the cam carrier being rotated, wherein the speed increasing side lead groove with which the speed increasing side switching pin is engageable for change from the low speed side cam lobe to the high speed side cam lobe and the speed decreasing side lead groove with which the speed decreasing side switching pin is engageable for change from the high speed side cam lobe to the low speed side cam lobe, wherein the speed increasing side lead groove includes:

a speed increasing side entry lead groove portion for accepting entry of the speed increasing side switching pin;

a speed increasing switching lead groove portion extending from the speed increasing side entry lead groove portion to guide the cam carrier in the axial direction so as to move to a high speed side axial position; and a high speed steady position lead groove portion for enabling the cam carrier guided by the speed increasing switching lead groove portion to rotate steadily at the high speed side axial position, wherein the speed decreasing side lead groove includes:

a speed decreasing side entry lead groove portion for accepting entry of the speed decreasing side switching pin;

a speed decreasing switching lead groove portion extending from the speed decreasing side entry lead groove portion to guide the cam carrier in the axial direction so as to move to a low speed side axial position; and a low speed steady position lead groove portion for enabling the cam carrier guided by the speed decreasing switching lead groove portion to rotate steadily at the low speed side axial position, wherein the speed increasing side entry lead groove portion is formed at a position axially overlapping the low speed steady position lead groove portion, and the speed decreasing side entry lead groove portion is formed at a position axially overlapping the high speed steady position lead groove portion, and wherein the speed increasing side switching pin and the speed decreasing side switching pin are arranged at a same axial position and at positions separated from each other in a circumferential direction of the cam carrier.

2. The variable valve-operating device according to claim 1, wherein:

one of the speed increasing side lead groove and the speed decreasing side lead groove has a smaller groove width and a larger depth to a groove bottom than an other of the speed increasing side lead groove and the speed decreasing side lead groove.

3. The variable valve-operating device according to claim 2, wherein:

the speed decreasing side lead groove has a smaller groove width and a larger depth to a groove bottom than the speed increasing side lead groove.

* * * * *